US006612241B2

(12) United States Patent
Avetisian

(10) Patent No.: US 6,612,241 B2
(45) Date of Patent: Sep. 2, 2003

(54) PYROTECHNIC INITIATOR WITH CENTER PIN HAVING A CIRCUMFERENTIAL NOTCH RETENTION FEATURE

(75) Inventor: Vahan Avetisian, Newbury Park, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 10/298,107

(22) Filed: Nov. 14, 2002

(65) Prior Publication Data

US 2003/0056679 A1 Mar. 27, 2003

Related U.S. Application Data

(63) Continuation-in-part of application No. 09/733,548, filed on Dec. 7, 2000, now abandoned.

(51) Int. Cl.[7] ..... F42B 3/10; F42B 3/12; F42B 3/18; F42C 11/00; F42C 15/00; F42C 19/12

(52) U.S. Cl. ..... 102/202.5; 102/202.1; 102/202.7; 102/202.9

(58) Field of Search ..... 102/202.1, 202.5, 102/202.7, 202.8, 202.9, 202.11, 202.14

(56) References Cited

U.S. PATENT DOCUMENTS

| | | | | | |
|---|---|---|---|---|---|
| 5,763,814 | A | * | 6/1998 | Avory et al. | 102/202.7 |
| 5,821,446 | A | * | 10/1998 | Chatley, Jr. | 102/202.7 |
| 5,939,660 | A | * | 8/1999 | Fogle, Jr. | 102/202.7 |
| 6,446,557 | B1 | * | 9/2002 | Lubbers | 102/202.9 |

* cited by examiner

*Primary Examiner*—Michael J. Carone
*Assistant Examiner*—H. A. Blackner
(74) *Attorney, Agent, or Firm*—Law Offices of Thomas J. Brindisi

(57) ABSTRACT

Disclosed is a pyrotechnic initiator header having a center pin with a circumferential notch retention feature that enhances secure and effective disposition of an ignition pyrotechnic charge droplet to the header in the area of the bridgewire.

14 Claims, 5 Drawing Sheets

PYROTECHNIC INITIATOR WITH CENTER PIN HAVING A CIRCUMFERENTIAL NOTCH RETENTION FEATURE

RELATED APPLICATION

This application is a continuation-in-part of assignee's application Ser. No. 09/733,548, filed Dec. 7, 2000, and entitled "Recessed Glass Header for Pyrotechnic Initiators now abandoned".

BACKGROUND OF THE INVENTION

The present invention relates to the field of initiators, and more particularly to a pyrotechnic initiator having a center pin with a circumferential notch retention feature.

Pyrotechnic initiators have many uses in industrial and consumer applications. One important use is the inflation of airbags in motor vehicles. As airbag production has steadily increased, significant efforts have been made to reduce the cost of reliable airbag initiators. One advance has been the use of a pyrotechnic droplet that is dispensed onto the header of the airbag initiator in a liquid or slurry form. For example, a generally suitable formula and techniques for dispensing liquid or slurry pyrotechnic droplets are described in U.S. Pat. No. 5,821,446 to Chatley, Jr., and U.S. Pat. No. 5,939,660 to Fogle, Jr., which are incorporated herein by reference as if set forth in full. A droplet can be dispensed with volumetric dispensing syringe-type equipment, or it can also be sprayed or placed after it is dispensed onto another part of the equipment.

And as is shown in FIG. 1 (generally depicting a header made by Nico Pyrotechnic of Trittau, Germany), it is known to use two pins 25 raised above the glass (45)/metal (60) header surface, with "nailheads" 26 on the ends of the pins 25, to help retain the droplet in place on the surface of the header. As shown by crack 27, however, after the liquid or slurry droplet 80 is dispensed and begins to harden, it tends to contract around the pins 25, creating a region between the pins 25 that is prone to cracking apart at crack 27. The effects of this are potentially magnified by the fact that such a crack may be immediately adjacent to the bridgewire 70. Further, in the plane of the nailheads of pins 25, a crack 28 may also form between the nailheads of the pins 25 and the edges of the droplet 80, potentially allowing the top of the droplet 80 to shear away from the rest of the droplet 80. Thus, there remains a need for improvement of the means of retaining such droplets in place on the header.

SUMMARY OF THE INVENTION

In accordance with the present invention, a header for an initiator is provided that includes a center pin with a circumferential notch retention feature. The circumferential notch retention feature of the center pin enhances secure and effective disposition of an ignition pyrotechnic charge droplet to the header in the area of the bridgewire.

DETAILED DESCRIPTION OF PREFERRED EMBODIMENTS

Figure 2:
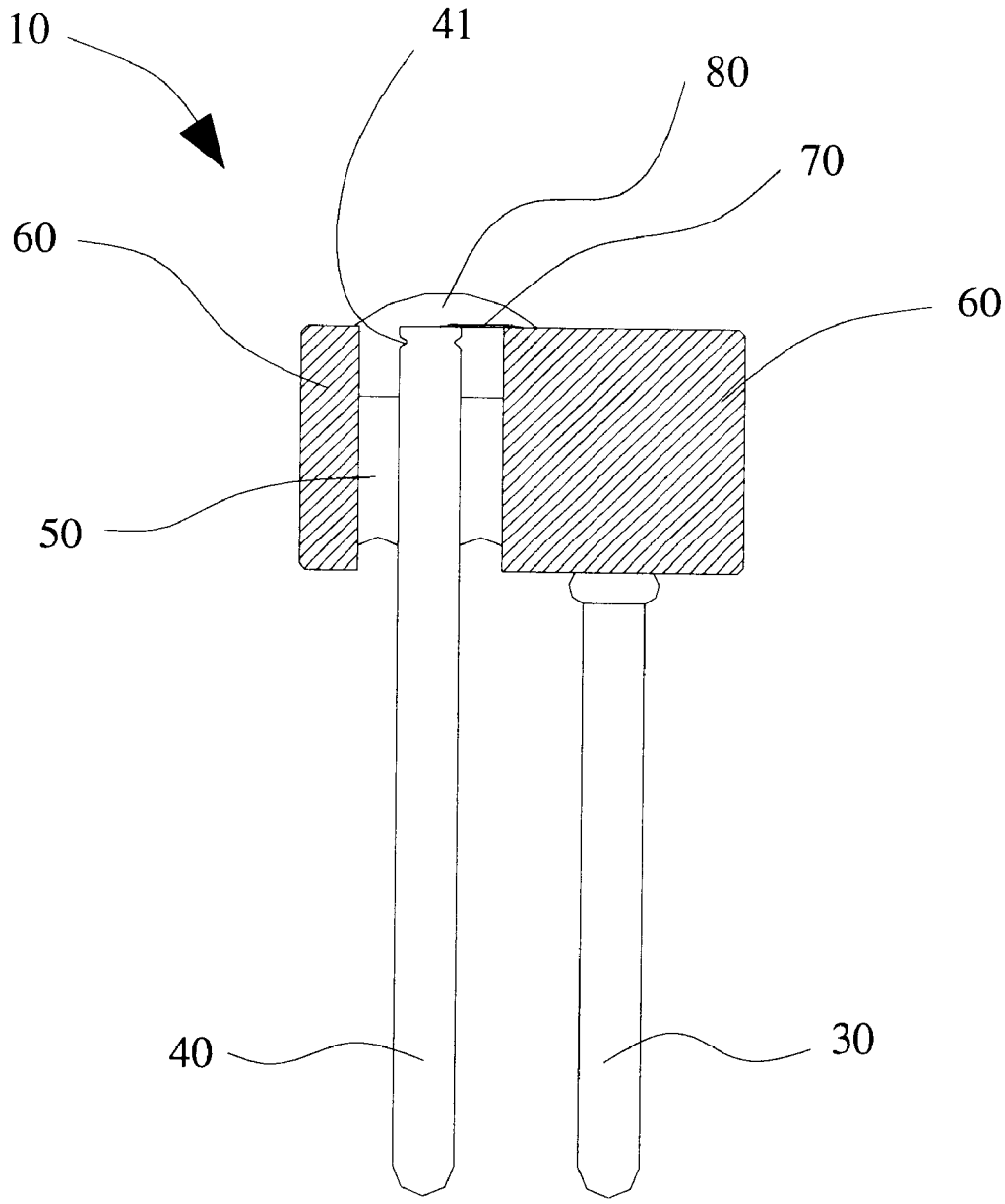
FIG. 2 is a side sectional view of an embodiment of the present invention.

As can be seen from FIG. 2, a preferred embodiment of a header 10 according to the present invention consists primarily of a ground pin 30, a center pin 40, a recessed glass 50, an eyelet 60, a bridgewire 70, and an ignition pyrotechnic charge droplet 80. The header 10 is generally like sealed-glass headers commonly used in airbag initiators, except that the glass 50 is recessed from the top surface of eyelet 60 as compared to conventional sealed-glass headers, wherein the glass is flush with the eyelet top surface. There are a number of ways to attain a recessed glass insulator. For example, the header can be fixtured upside-down, using a fixture that includes a carbon or other suitable projection (not shown) to displace glass 50 (but not pin 40) away from the top surface of eyelet 60 during heating and sealing. Alternately, the header might be fixtured right-side-up, using a fixture that includes means positioned below glass 50 to support it at the appropriate height during heating and sealing. While steps can also be taken to ensure that the top surface of glass 50 is flat (as shown in FIG. 2), a meniscus (not shown) on the top surface of glass 50 is generally acceptable.

The recessed nature of recessed the glass 50 in the embodiment of FIG. 2 eliminates the need for grinding the top surface of the header, since bridgewire 70 can be welded to center pin 40 on one end and to eyelet 60 on the other end without concern for weld electrodes contacting the glass or other surfaces higher than the weld surface. Because the features needed for bridgewire welding are thus already present without the need for header surface grinding, eyelet 60 can be manufactured by methods, such as stamping or cold-forming, which are significantly cheaper than the machining operation used for most current eyelets.

Further, because the recessed upper surface of recessed glass 50, the inner surface of the bore of eyelet 60, and center pin 40 together form a cavity, the ignition pyrotechnic droplet 80 can be more advantageously disposed and held around bridgewire 70. The cavity promotes an enhanced degree of contact between droplet 80 and bridgewire 70, and also helps secure droplet 80 against movement (such as during physical environmental testing).

As evident to one of ordinary skill in the art, the header of the present invention can be pressed into a suitable can (not shown) that is loaded with a suitable output pyrotechnic charge (such as one provided using a conventional slurry loading process). The header can then be hermetically sealed (for example, with a through-weld) to the can to form an initiator sub-assembly, which can in turn be completed by, for example, a suitable method of insert-molding a nylon body to provide electrical insulation and structural support.

Figure 1:
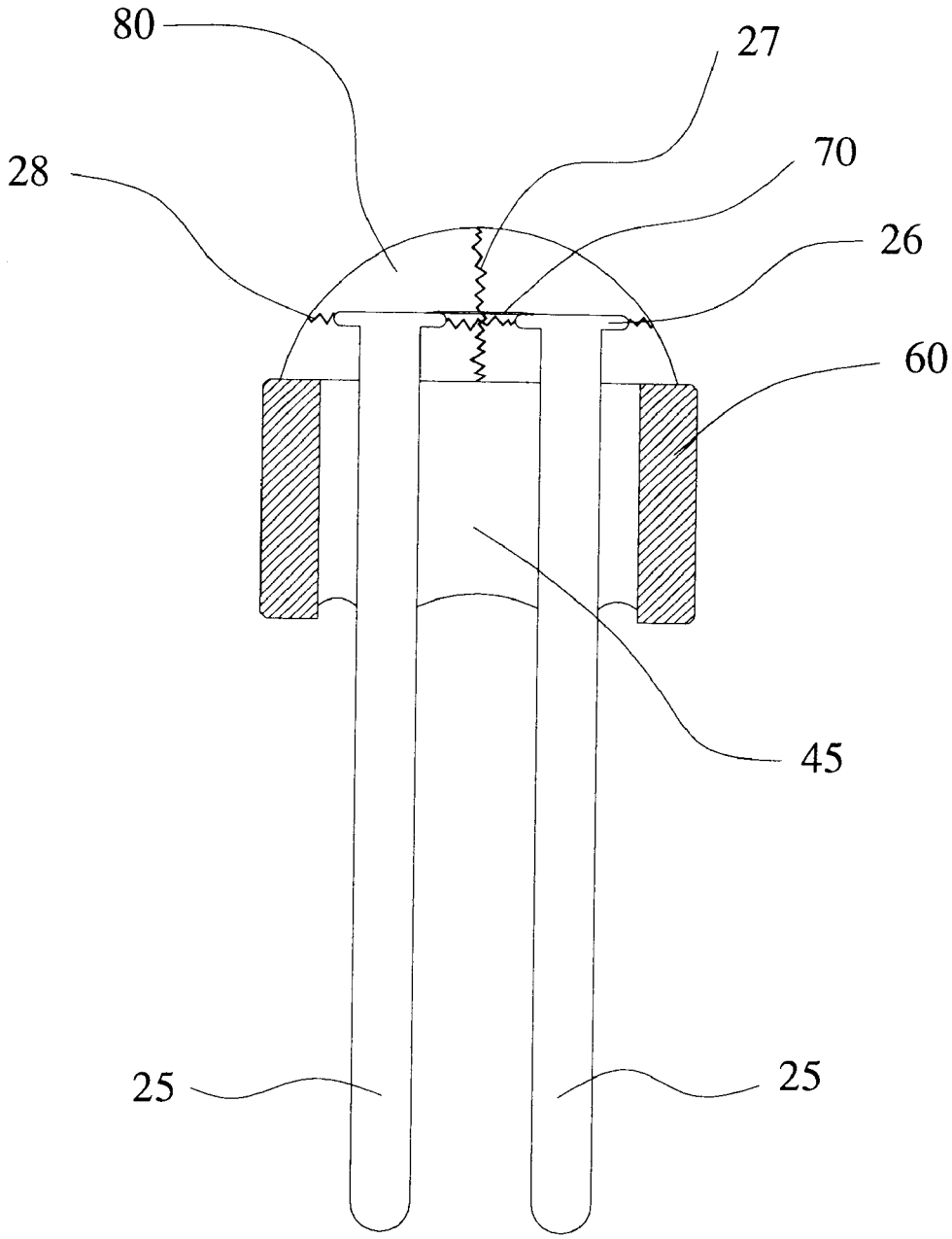
Figure 1 PRIOR ART
FIG. 1 is a side sectional view of a prior art header.

Retention of droplet 80 in its place (and thus maintenance of good contact with bridgewire 70) is enhanced by the provision of a circumferential notch 41 or other irregular surface near the top of center pin 40. By using a retention feature located on a single central pin (rather than a retention feature located on the eyelet as shown in the Chatley Jr. patent, or two pins as shown in FIG. 1), the droplet is permitted to contract inwardly toward the retention feature rather than away from it, thereby increasing (rather than reducing) the securing of the droplet to the retention feature upon drying and contraction. Further, applicant has discovered that the large surface area of a nailhead feature disadvantageously increases the likelihood of cracking between the pin and the edge of the droplet (such as is shown by crack 28 in FIG. 1). Thus, the retention feature of the present invention, which has a small surface area, is less prone to such cracking.

Figure 3:
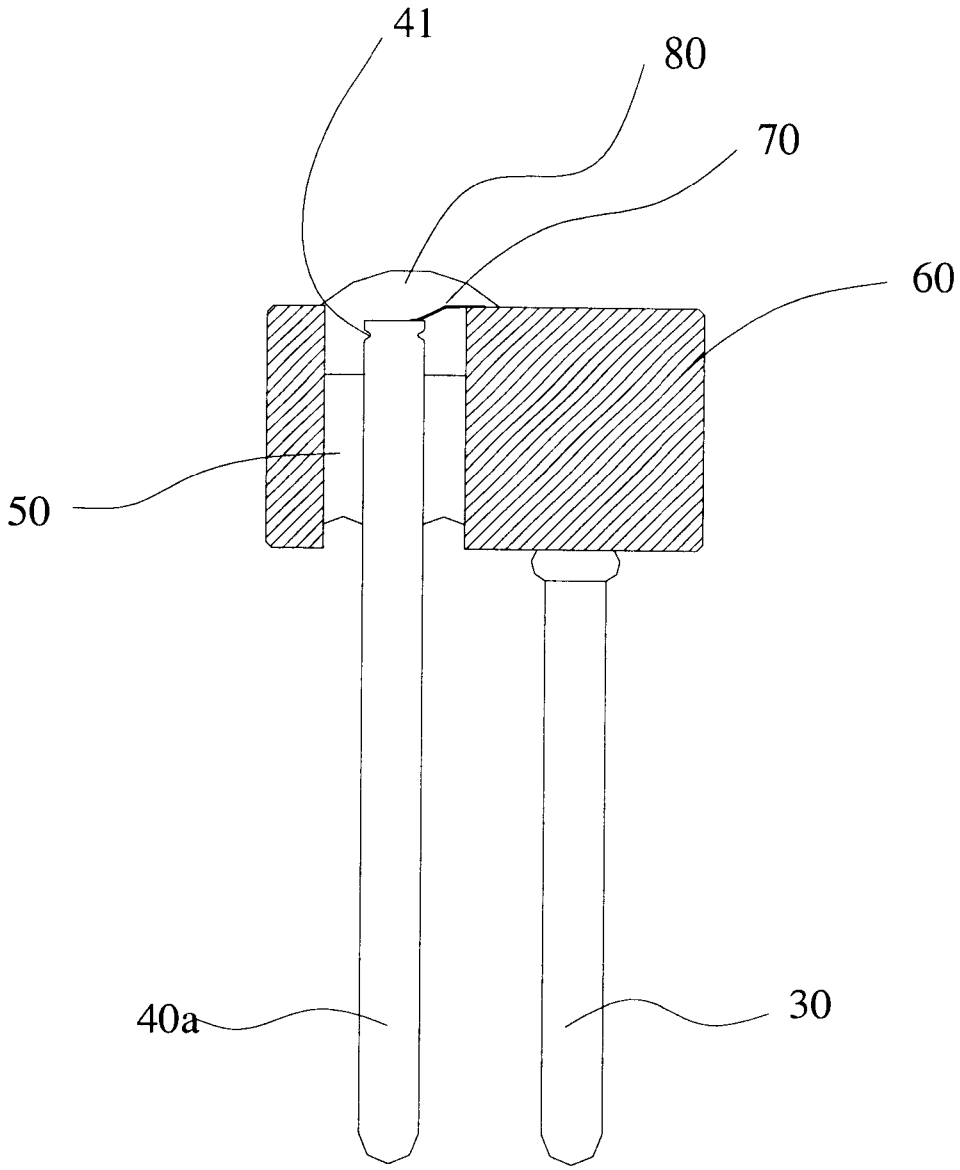
FIG. 3 is a side sectional view of an alternate embodiment of the present invention.
Figure 4:
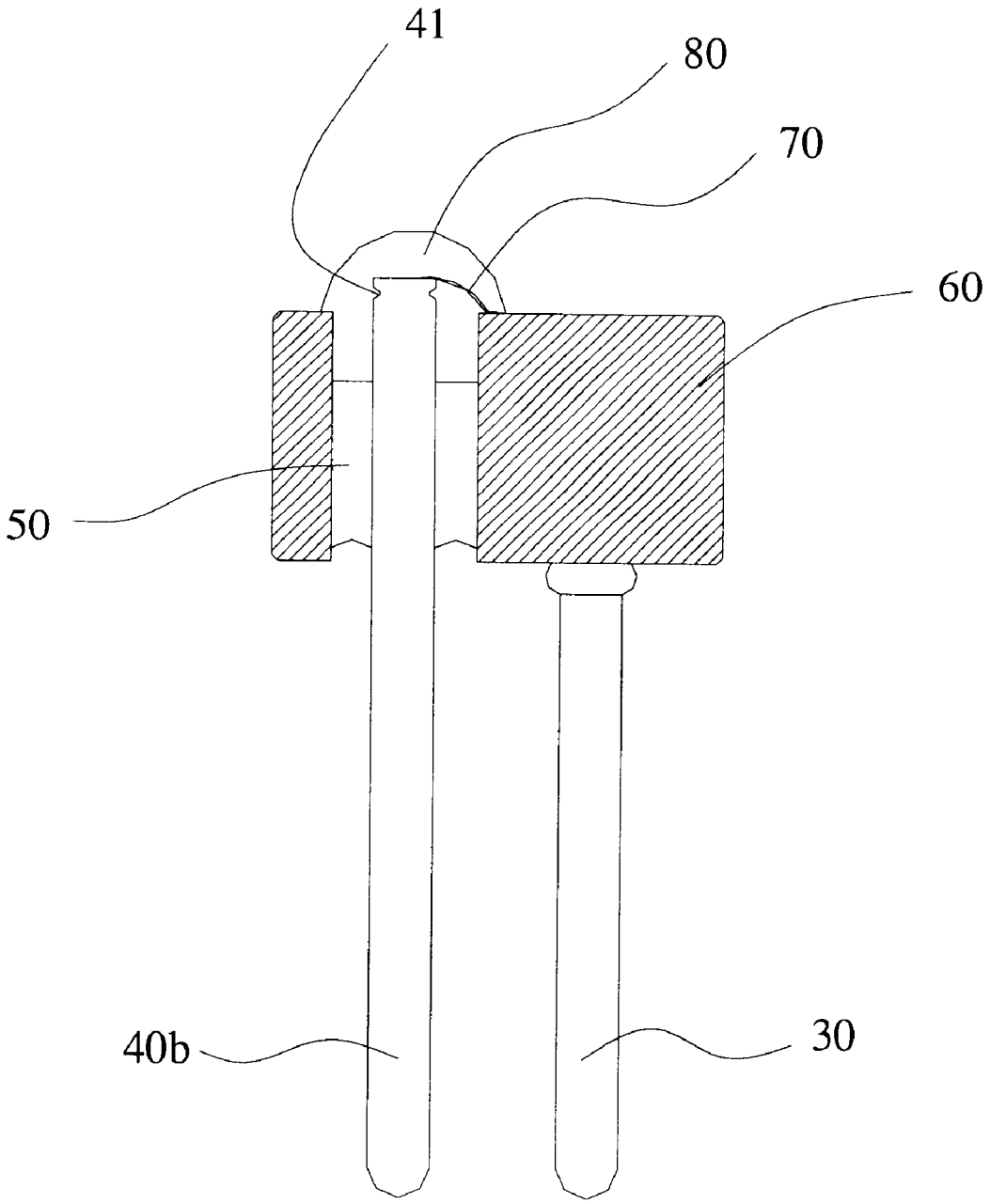
FIG. 4 is a side sectional view of another alternate embodiment of the present invention.
Figure 5:
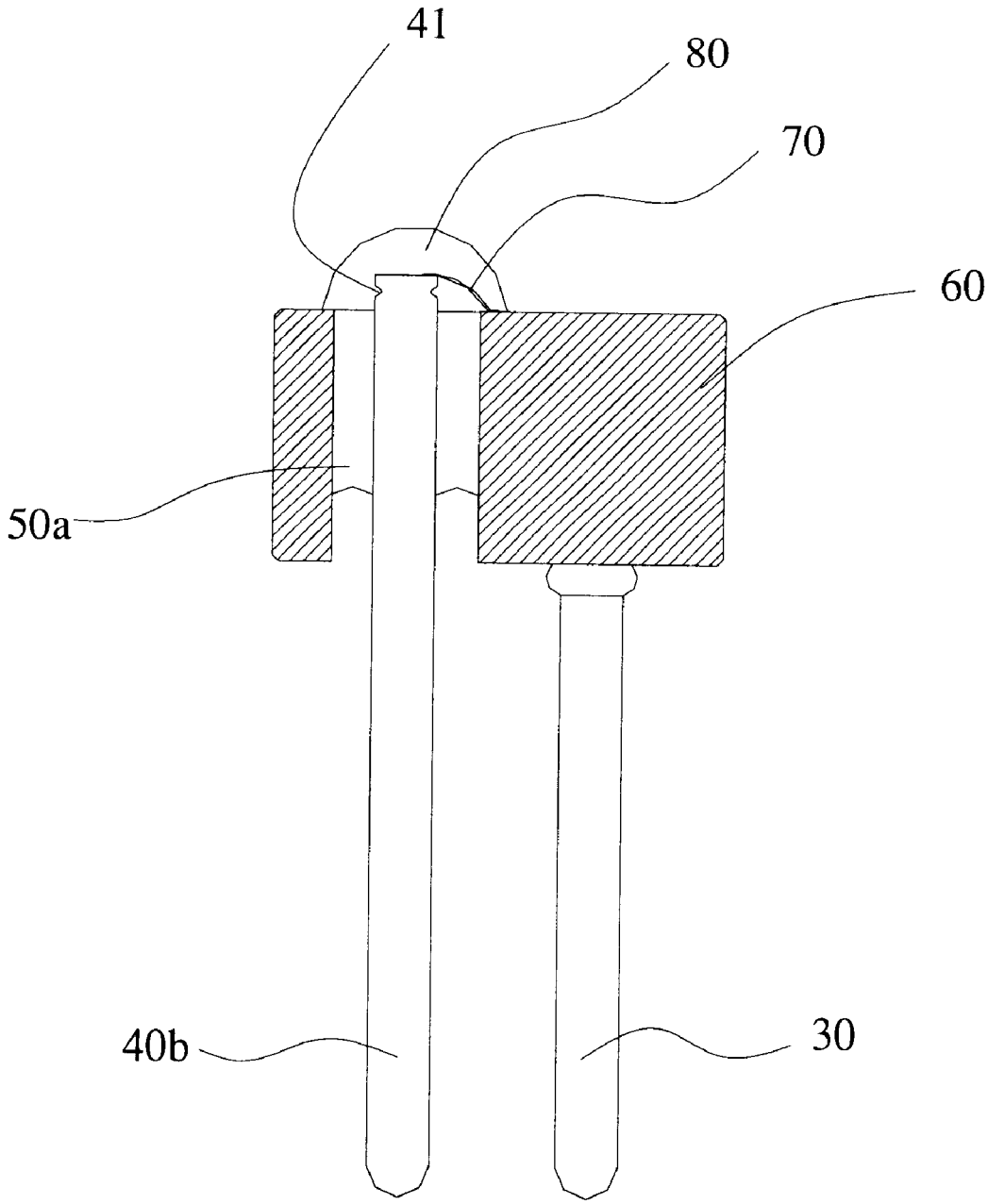
FIG. 5 is a side sectional view of yet another alternate embodiment of the present invention.

FIGS. 3 and 4 respectively show alternate embodiments of the present invention, wherein the center pin (40*a*) is recessed below the eyelet surface, and the center pin (40*b*) extends above the eyelet surface, and FIG. 5 shows an alternate embodiment wherein the center pin (40*b*) extends above the eyelet and the glass 50*a* is flush with the eyelet.

Preferred embodiments of a header with a center pin having a circumferential notch retention feature, and many of there attendant advantages, have thus been disclosed. It will be apparent, however, that various changes may be made in the form, construction and arrangement of the parts without departing from the spirit and scope of the invention, the form hereinbefore described being merely a preferred or exemplary embodiment thereof. Therefore, the invention is not to be restricted or limited except in accordance with the following claims and their legal equivalents.

What is claimed is:

1. A header for use in a pyrotechnic initiator, comprising:

a) an electrically conductive eyelet having an upper eyelet surface, and having an eyelet bore defining an inner eyelet surface;

b) a glass insulator having an outer glass surface and an upper glass surface, and having an insulator bore defining an inner glass surface, wherein said outer glass surface is sealed to said inner eyelet surface; and, c) an electrically conductive center pin having an upper end, a longitudinal axis, said electrically conductive center pin being disposed within said insulator bore and sealed to said inner glass surface, d) wherein said electrically conductive center pin includes a low-surface-area retention feature on its upper end, said low-surface-area retention feature extending inwardly of said longitudinal axis of said electrically conductive center pin, for use in retaining a pyrotechnic material.

2. The header of claim 1, wherein said upper glass surface is disposed below said upper eyelet surface.

3. The header of claim 2, wherein said upper end of said electrically conductive center pin is coplanar with said upper eyelet surface.

4. The header of claim 2, wherein said upper end of said electrically conductive center pin is below with said upper eyelet surface.

5. The header of claim 1, wherein said upper end of said electrically conductive center pin extends above said upper eyelet surface, and said upper glass surface is disposed below said upper eyelet surface.

6. The header of claim 1, wherein said upper end of said electrically conductive center pin extends above said upper eyelet surface, and said upper glass surface is flush with said upper eyelet surface.

7. The header of claim 1, further comprising a pyrotechnic droplet disposed on said upper eyelet surface, upper glass surface, and around low-surface-area retention feature of said electrically conductive center pin.

8. The header of claim 1, wherein said exposed low-surface-area retention feature is a circumferential notch.

9. The header of claim 8, wherein said upper glass surface is disposed below said upper eyelet surface.

10. The header of claim 9, wherein said upper end of said electrically conductive center pin is coplanar with said upper eyelet surface.

11. The header of claim 9, wherein said upper end of said electrically conductive center pin is below with said upper eyelet surface.

12. The header of claim 8, wherein said upper end of said electrically conductive center pin extends above said upper eyelet surface, and said upper glass surface is disposed below said upper eyelet surface.

13. The header of claim 8, wherein said upper end of said electrically conductive center pin extends above said upper eyelet surface, and said upper glass surface is flush with said upper eyelet surface.

14. The header of claim 8, further comprising a pyrotechnic droplet disposed on said upper eyelet surface, upper glass surface, and around low-surface-area retention feature of said electrically conductive center pin.

* * * * *